United States Patent [19]

Ahmed

[11] 4,085,359

[45] Apr. 18, 1978

[54] SELF-STARTING AMPLIFIER CIRCUIT

[75] Inventor: Adel Abdel Aziz Ahmed, Annandale, N.J.

[73] Assignee: RCA Corporation, New York, N.Y.

[21] Appl. No.: 713,821

[22] Filed: Aug. 12, 1976

[30] Foreign Application Priority Data

Feb. 3, 1976 United Kingdom ..... 04209/76

[51] Int. Cl.[2] ..... G05F 1/56

[52] U.S. Cl. ..... 323/22 T; 363/49

[58] Field of Search ..... 323/1, 4, 22 T; 321/45 S; 363/49

[56] References Cited

U.S. PATENT DOCUMENTS

| | | | |
|---|---|---|---|
| 2,922,945 | 1/1960 | Norris et al. | 323/22 T |
| 3,344,340 | 9/1967 | Webb | 323/22 T |
| 3,911,353 | 10/1975 | van de Plassche | 323/4 |

OTHER PUBLICATIONS

D.A.T.A. Book Electronics Information Series "Linear Integrated Circuits" 1977, vol. 1, p. 218, FIG. FO88.

*Primary Examiner*—Gerald Goldberg
*Attorney, Agent, or Firm*—H. Christoffersen; A. L. Limberg; R. G. Coalter

[57] ABSTRACT

A circuit for producing a band-gap reference voltage comprising first and second current amplifiers connected in a regenerative feedback loop and which includes a starting circuit. The latter initiates current flow in the loop and is automatically disconnected from the loop once the circuit output voltage reaches the band-gap value.

4 Claims, 1 Drawing Figure

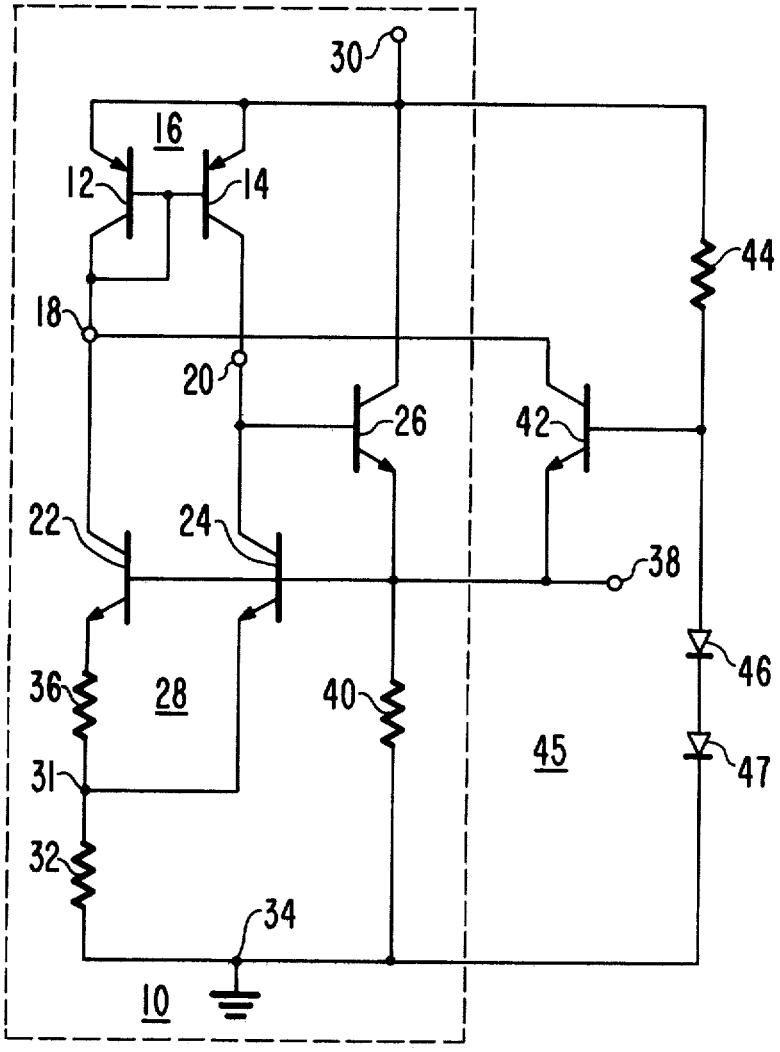
30
16
12
14
44
18
20
26
42
22
24
38
46
36
28
40
45
47
31
32
34
10

SELF-STARTING AMPLIFIER CIRCUIT

This invention relates to improved amplifier circuits and in particular to such circuits which produce a reference voltage having a value substantially unaffected by temperature variation.

The sole FIGURE is a schematic circuit diagram of a preferred embodiment of the invention.

Referring to the FIGURE, the portion of the circuit shown within the dashed lines is a voltage source 10 similar to one known in the art (see A. P. Brokaw, "A Simple Three-Terminal I.C. Bandgap Reference", IEEE J. Solid State Circuits, Vol. SC-9, No. 6, December 1974, p. 338, FIG. 3). PNP transistors 12 and 14 comprise an amplifier 16 of the current mirror amplifier (CMA) type whose input node is connected to terminal 18 and whose output node is connected to terminal 20. NPN transistors 22, 24 and 26 comprise a second amplifier 28 also of the CMA type whose input node is connected to terminal 20 and whose output node is connected to terminal 18. (The base-to-collector feedback circuit for the input current path of CMA 28 is via the emitter-base path of transistor 26, as discussed later). The emitters of transistors 12 and 14 are connected to terminal 30 to which an operating potential may be applied. The bases of these transistors are connected to each other and to the collector of transistor 12. This collector is connected to terminal 18 while the collector of transistor 14 is connected to terminal 20. Also connected to terminal 20 are the base and collector of transistors 26 and 24, respectively. The emitter of transistor 24 is connected via node 31 and resistor 32 to a point 34 at a reference potential, herein ground. The emitter of transistor 22 is connected to node 31 via resistor 36 and its collector is connected to terminal 18. The bases of transistors 22 and 24 as well as the emitter of transistor 26 are interconnected at output terminal 38. Resistor 40 is connected between terminal 38 and node 34. The collector of transistor 26 is connected to terminal 30.

The collector of transistor 42 is connected to terminal 18 while its emitter is connected to terminal 38. The base of this transistor is connected to one end of resistor 44 and through diodes 46 and 47 to ground. Each diode may comprise a NPN transistor connected base-to-collector. The other end of resistor 44 is connected to terminal 30.

In the operation of the circuit of the FIGURE, source 10 produces a voltage at output terminal 38 whose value ideally is independent of temperature variations. This zero temperature coefficient output voltage is obtained by combining two voltages, one having a negative temperature coefficient, and the other a positive temperature coefficient. A voltage having a positive temperature coefficient may be obtained in the following manner. Transistors 22 and 24 are operated at different emitter current densities. These different densities may be realized by operating the two transistors with different emitter currents or by operating them with the same emitter currents and making the emitter area of one transistor different from the area of the other or by a combination of the above techniques.

In the present embodiment, the transistors are operated at the same current levels but the base-emitter junction area of transistor 22 is greater than the corresponding area of transistor 24 by a factor of ten. As a result, transistor 22 has a lower current density than transistor 24. This means that the forward base-emitter voltage drop ($V_{be}$) of transistor 22 is less than the $V_{be}$ of transistor 24 for a given level of collector current. A voltage is produced across resistor 36 that is equal to the difference in the two $V_{be}$'s. A current flows through this resistor that is proportional to this voltage difference. Since this current also flows into resistor 32, the voltage across this resistor is also proportional to the voltage difference. This voltage difference may be shown to have a positive temperature coefficient. The voltage $V_{be}$ is known to have a negative temperature coefficient. If the circuit parameters are properly chosen, the voltage across resistor 32 may be combined with the $V_{be}$ of transistor 24 such that their temperature coefficients cancel, thereby producing a voltage at terminal 38 having the desired temperature characteristics. The approach zero temperature coefficient, the output voltage at terminal 38 should ideally equal the energy band-gap voltage, extrapolated to 0° K, of the semi-conductor material from which the devices are fabricated. For silicon, this extrapolated voltage is approximately 1.24 volts.

As mentioned previously, the base-emitter junction of transistor 26 provides a feedback connection between the collector and base of transistor 24. Thus, amplifier 28 may be viewed as a current mirror amplifier having emitter degeneration provided by resistor 32. The advantage of using transistor 26 as the feedback element rather than a direct connection between the base and collector of transistor 24 is that the base currents for transistors 22 and 24 are controlled by current flow through terminal 20. The diversion of current from the collector of transistor 24 causes an imbalance in the collector currents of transistors 22 and 24. The addition of transistor 26 reduces this imbalance by a factor substantially equal to the forward current gain of transistor 26. Current mirror amplifier 16 senses the departure from the desired value of current relationship in transistors 22 and 24 and in response thereto adjusts the base current of transistor 26 to maintain the current flowing through transistors 22 and 24 in the desired relationship.

A shortcoming of the above described circuit is that it is not self-starting. Amplifiers 16 and 28 are interconnected in a regenerative, or positive feedback, configuration. That is, the input and output nodes of amplifier 16 are connected to the output and input nodes, respectively, of amplifier 28. When an operating voltage is applied to terminal 30, no current flows in either amplifier and transistors 12, 14, 22, 24 and 26 are off. Some means external to source 10 is needed to initiate proper circuit operation.

When used in conjunction with a band-gap reference source, a starting circuit should have certain desirable characteristics. For example, once normal circuit operation has been attained in the reference circuit, the starting circuit should be disabled so that it will have no detrimental effect on the accuracy of the reference source. In addition, the starting circuit should not unduly stress any of the components of circuit 10. This is because these components often are constructed to have electrical characteristics closely matched to each other to better achieve the desired source accuracy. In such an application, an excessive current flow through or voltage across one of these components may upset this match. Thus, the use of starting circuits utilizing reactive elements should be avoided. A final consideration when the reference circuit is to be constructed in integrated circuit form is that, for ease of fabrication, the elements of the starting circuit should employ the same type of devices, e.g., bipolar devices, as those used in the reference circuit.

The starting circuit comprising elements 42, 44, 46 and 47 embodies the above desired characteristics. These elements plus resistor 40, which provides degenerative feedback, comprise a current mirror amplifier 45. The input circuit of the current mirror amplifier comprises diodes 46 and 47. As already mentioned, these diodes may be realized with NPN bipolar transistors each having its respective base and collector regions interconnected. Alternatively, the diode pair may be realized as a diode-connected compound transistor configuration of the Darlington type.

In operation, when an operating voltage is applied to terminal 30, voltage source 10 initially is off. This voltage causes current to flow through resistor 44 and the input current path 46, 47 of the CMA 45. This establishes a corresponding current in the output path (transistor 42 and resistor 40) of the CMA 45. This output current flows through the emitter-to-collector path of transistor 12 of amplifier 16.

The initiation of current flow through transistor 12 conditions transistor 14 to conduct current. A small portion of the collector current of transistor 14 flows into the base of transistor 26, turning this transistor on. As a result, current is supplied to resistor 40 both from the emitter of transistor 26 and the emitter of transistor 42. This combined current flow causes the voltage at node 38, as measured with respect to the reference potential, to increase. The increasing voltage tends to turn off transistor 42 and turn on transistors 22 and 24. At low current levels, the emitter impedance of transistor 22 is large with respect to the impedance of resistors 36 and 32. As a result, emitter resistors 36 and 32 have little effect on the gain of transistor 22 and the gain of this transistor is essentially 10, 10 being the aforementioned area ratio. This relatively high gain causes the loop comprising amplifiers 16 and 28 to be regenerative. This regeneration establishes normal operation of voltage source 10 thereby causing the voltage at terminal 38 to rise to the band-gap level of approximately 1.24 volts. The presence of this voltage at terminal 38 causes the base-emitter junction of transistor 42 to be reverse biased thereby turning this device off. As a result, the start-up circuit has no further effect on the operation of source 10. After transistor 42 is turned off, a current path continues to exist through resistor 44 and diodes 46 and 47. However, the value of resistor 44 may be made sufficiently large such that this quiescent current flow is not objectionable.

It should be appreciated that the starting circuit of the present application will function with source 10 when amplifiers 16 or 28 are replaced with other current amplifiers known in the art. It also may be used with regenerative circuits other than that illustrated in the FIGURE that have starting problems. In addition, the circuit of the FIGURE may be realized with transistors having conductivities opposite to those shown with suitable choice of operating voltages, or with such conductor-insulator-semiconductor devices as metal-oxide-semiconductor transistors.

What is claimed is:

1. In a circuit comprising first and second terminals for application of an operating potential therebetween; first and second current amplifiers, each amplifier having an input and an output current path and a common node, said first current amplifier input and output current paths connected to said second current amplifier output and input paths respectively forming a positive feedback loop thereby, said first current amplifier common node connected to said first terminal, said second current amplifier common node connected to said second terminal, means for degenerating the open loop gain of said positive feedback loop to unity when the levels of current in said loop exceed equilibrium values and a resistance in series connection with the input current path of said second current amplifier between the output current path of said first current amplifier and said second terminal, wherein said circuit has the undesirable tendency to fail to initiate conduction within said loop upon application of said operating voltage thereto, a starting circuit for overcoming said undesirable tendency, comprising, a transistor having an emitter electrode connected to the end of said series connection remote from said second terminal, having a collector electrode connected for conditioning the transistor for normal transistor operation, and having a base electrode;

means responsive to said operating voltage being applied for applying a substantially constant direct potential between said second terminal and the base electrode of said transistor of a value such that said transistor is conductive to supply its emitter current to the input current path of said second current amplifier as a starting current, until conduction levels within said loop reach predetermined values smaller than said equilibrium values, whereupon the potential drop across said resistance increases the potential across said series connection to reverse-bias the base-emitter junction of said transistor and terminate the application of said emitter current.

2. The combination set forth in claim 1 wherein the collector electrode of said transistor is connected to the input current path of said first current amplifier to provide it an auxiliary starting current whenever said transistor is conductive.

3. In combination:

a first current mirror amplifier having input, output and common nodes;

a second current mirror amplifier having input, output and common nodes, said second current mirror amplifier input and output nodes connected to said first current mirror amplifier output and input nodes, respectively;

a circuit output terminal connected to said second current mirror amplifier input node;

a first impedance connected between said second current mirror amplifier common node and a point at a reference potential;

a second impedance connected between said output terminal and said point at a reference potential;

a transistor having a conduction path and a control electrode, said conduction path connected between said first current mirror amplifier input node and said output terminal;

a direct current conductive path including a third impedance connecting said control electrode and said first current mirror amplifier common node; and first and second diodes serially connected between said control electrode and said point at a reference potential, each poled to be forward-biased by current flowing through said direct current conductive path.

4. The combination of claim 3 further including a second transistor having a conduction path and a control electrode, said second transistor control electrode connected to said second current mirror amplifier input node and said second transistor conduction path connected between said output terminal and said first current mirror amplifier common node.

* * * * *